US005366207A

United States Patent [19]

Lin

[11] Patent Number: 5,366,207

[45] Date of Patent: Nov. 22, 1994

[54] APPARATUS FOR MAKING METAL-MATRIX COMPOSITES REINFORCED BY ULTRAFINE REINFORCING MATERIALS

[76] Inventor: Ching-Bin Lin, c/o Hung Hsing Patent Service Center, P.O. Box 55-1670, Taipei (104), Taiwan, Prov. of China

[21] Appl. No.: 188,754

[22] Filed: Jan. 31, 1994

Related U.S. Application Data

[62] Division of Ser. No. 103,049, Jul. 28, 1993.

[51] Int. Cl.[5] ..... C21C 7/00

[52] U.S. Cl. ..... 266/216; 266/235

[58] Field of Search ..... 266/200, 208, 216, 217, 266/235, 275

[56] References Cited

U.S. PATENT DOCUMENTS

| | | | |
|---|---|---|---|
| 4,240,618 | 12/1980 | Ostberg | 266/235 |
| 4,244,562 | 1/1981 | Archenholtz | 266/216 |
| 4,470,846 | 9/1984 | Dubé | 266/235 |
| 4,541,866 | 9/1985 | Meyer | 266/216 |
| 4,717,540 | 1/1988 | McRae et al. | 266/216 |

*Primary Examiner*—Scott Kastler

[57] ABSTRACT

An apparatus for making metal-matrix composite includes a feeding container filled with a suspension liquid in the suspending an ultrafine reinforcing material having a particle size as fine as 0.05 μm in a suspension liquid in the container, a refining furnace filled with a molten metal alloy matrix in the refining furnace with the suspension liquid of the ultrafine reinforcing material homogeneously dispersed in the metal alloy matrix for producing a metal-matrix composite by a refining process, which is degassed by inserting a degassing pipe in the furnace to remove gases to eliminate porosity in the composite, thereby producing a metal-matrix composite having improved mechanical properties.

7 Claims, 2 Drawing Sheets

APPARATUS FOR MAKING METAL-MATRIX COMPOSITES REINFORCED BY ULTRAFINE REINFORCING MATERIALS

This application is a divisional application of an invention patent application filed by the same inventor of this application on: Jul. 28, 1993, given a Ser. number of: 08/103,049.

BACKGROUND OF THE INVENTION

A conventional metal-matrix composite may be incorporated with fine reinforcing material therein for strengthening its mechanical property.

However, the fine reinforcing material, once directly fed into a metal matrix, the fine particles due to Van der walls force existing among the particles, will cluster in the metal matrix mixed with the fine particles of the reinforcing material, thereby causing unhomogeneous dispersion of the fine particles in the matrix and deteriorating the property of a finished casting product therefrom.

Meanwhile, a fine reinforcing material of dry particulates is directly incorporated into a molten metal alloy such as an aluminum alloy, the dry fine particulate reinforcing material will easily fly over as effected by a convection hot air streamflow above the molten alloy to cause loss of the fed reinforcing material. Meanwhile, the feed rate for adding the fine reinforcing material into the matrix will be difficultly controlled.

By using a vortex agitator for refining a metal-matrix composite, gases may be directed into the molten metal solution which should be removed by a degassing operation before casting process. Re-melting the metal-matrix composite under high vacuum degree may remove partial gases in the composite. However, the molten metal solution has a high viscosity, thereby being uneasy to extract gases outwardly from the viscous molten solution.

It is therefore expected to invent an apparatus for well incorporating fine particulate reinforcing material into the metal matrix during its refining process, and also providing a reliable degassing means for efficiently removing gases in the composite product.

SUMMARY OF THE INVENTION:

The object of the present invention is to provide an apparatus for making metal-matrix composite by adding ultrafine reinforcing material having a particle size preferably as fine as 0.05 μm or even finer into a metal alloy matrix to be homogeneously dispersed in the matrix in a refining furnace, which is degassed by inserting a degassing pipe in the furnace to remove gases from the composite to eliminate porosity in the composite, thereby producing metal-matrix composite having improved mechanical properties.

DETAILED DESCRIPTION

Figure 1:
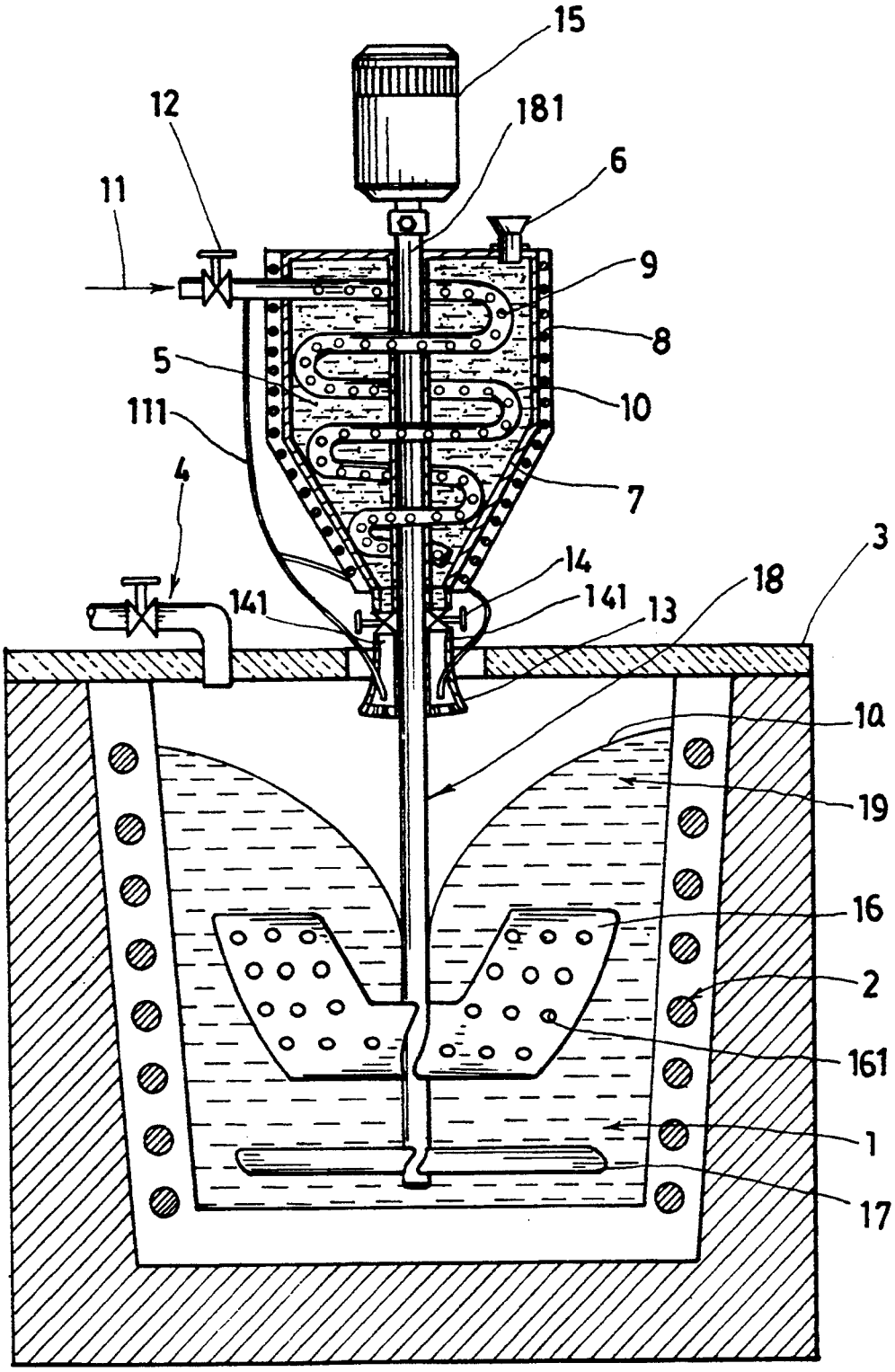
FIG. 1 shows an apparatus for making the metal matrix composite in accordance with the present invention.

An apparatus for making metal-matrix composites of the present invention is shown in FIG. 1, which includes:

a heating furnace or crucible (such as heated by electric resistors) 2 filled with a metal matrix or metal alloy matrix such as an aluminum alloy matrix 1 for melting the aluminum alloy matrix 1 and having a ceramic cover 3 covering an upper opening of the furnace 2;

an inert gas supply means 4 having a conduit connected to the furnace 2 for directing inert gas such as nitrogen or argon gas into the furnace 2 for blanketing a molten alloy solution in the furnace 2 for preventing oxidation thereof;

a closed feeding container or charger 7 mounted on an upper position of the furnace 2, having a suspension-liquid valve 6 provided on an upper portion of the feeding container 7 for filling a suspension liquid 5 of ultrafine reinforcing material selected from the group of: alumina, silicon nitride, silicon carbide, titanium carbide, zirconium oxide, boron carbide, and tantalum carbide, which is dispersed in distilled water and dispersing agent, in the feeding container 7, a heating medium 8 such as a heating coil surrounding the feeding container 7 for producing heat convection in the container 7 for heating the suspension liquid 5 in the feeding container 7, an inert-gas pipe or a coil tube 10 (which may be made of stainless steel) disposed in the feeding container 7 having a plurality of perforations 9 drilled in the inert-gas pipe 10 for bubbling inert gas such as nitrogen gas supplied from a nitrogen source or bottle 11 through a gas valve 12 formed on an inlet portion of the inert-gas pipe 10 for keeping a well dispersion condition of the suspension liquid 5 for preventing cluster, and at least a distributing pipe 141 having a distribution-control valve 14 formed on the distributing pipe 141 and a nozzle 13 secured on a lowest end portion of the distributing pipe 141 for distributing, spraying or atmomizing suspension liquid 5 from the feeding container 7 into the furnace 2 (Note: In order to effectively atomize the suspension liquid into the furnace 2, a compressed inert gas by-pass pipe 111 is branched from pipe 11 and led into nozzle 13 by applying the compressed inert gas to help atomize the suspension liquid into the furnace through the nozzle 13.);

an agitating means 18 provided in the furnace 2 for thoroughly mixing the aluminum alloy matrix 1 with the suspension liquid 5 sprayed or atomized from the feeding container 7; and a degassing means 20 provided in the furnace 2 for removing gases existing in the molten solution 19 by mixing the aluminum alloy matrix 1 with the suspension liquid 5 containing the ultrafine reinforcing material for preventing porosity of a finished casting product of this invention.

The agitating means 18 includes: an agitator shaft 181 (which may be coated with an alumina coating for protecting the shaft) secured to a driving motor 15 (such as a direct-current motor with variable speed adjustment) mounted above the feeding container 7 having the agitator shaft 181 passing through a central portion in the feeding container 7 and protruding downwardly into the furnace 2, and a plurality of impellers such as an upper and a lower impellers 16, 17 respectively radially secured to the agitator shaft 181 submerged in the molten solution 19 in the furnace 2 for thoroughly mixing the matrix 1 with the suspension liquid 5 containing the ultrafine reinforcing material of the present invention.

The upper impeller 16 includes a plurality of upper blades generally vertically oriented with each upper blade generally perpendicular to an inside vertical wall in the furnace 2, having a plurality of blade perforations 161 formed in each upper blade for increasing the shear strength of the upper blades when rotated to increase an efficient dispersion of the ultrafine particles of the reinforcing material in the alloy matrix. The upper blades are able to produce helical cone or vortex 1*a* as shown in FIG. 1 to recirculatively turnover an upper layer of the molten solution 19 (sprayed with the suspension liquid 5) into the lower layer of the molten solution 19 to thoroughly mix the alloy matrix 1 with the ultrafine reinforcing material in the furnace 2.

The lower impeller 17 includes a plurality of lower blades radially secured to a lower portion of the agitator shaft 181 below the upper blades of the upper impeller 16, the lower blades of the lower impeller being formed as a propeller which may have a projective side view generally horizontal to a bottom surface in the furnace 2, but not limited in this invention. The lower blades may produce convection flow in the furnace for thoroughly mixing the alloy with the reinforcing material especially in the bottom portion of the furnace 2. Other designs of impeller blades may be made in this invention.

Figure 2:
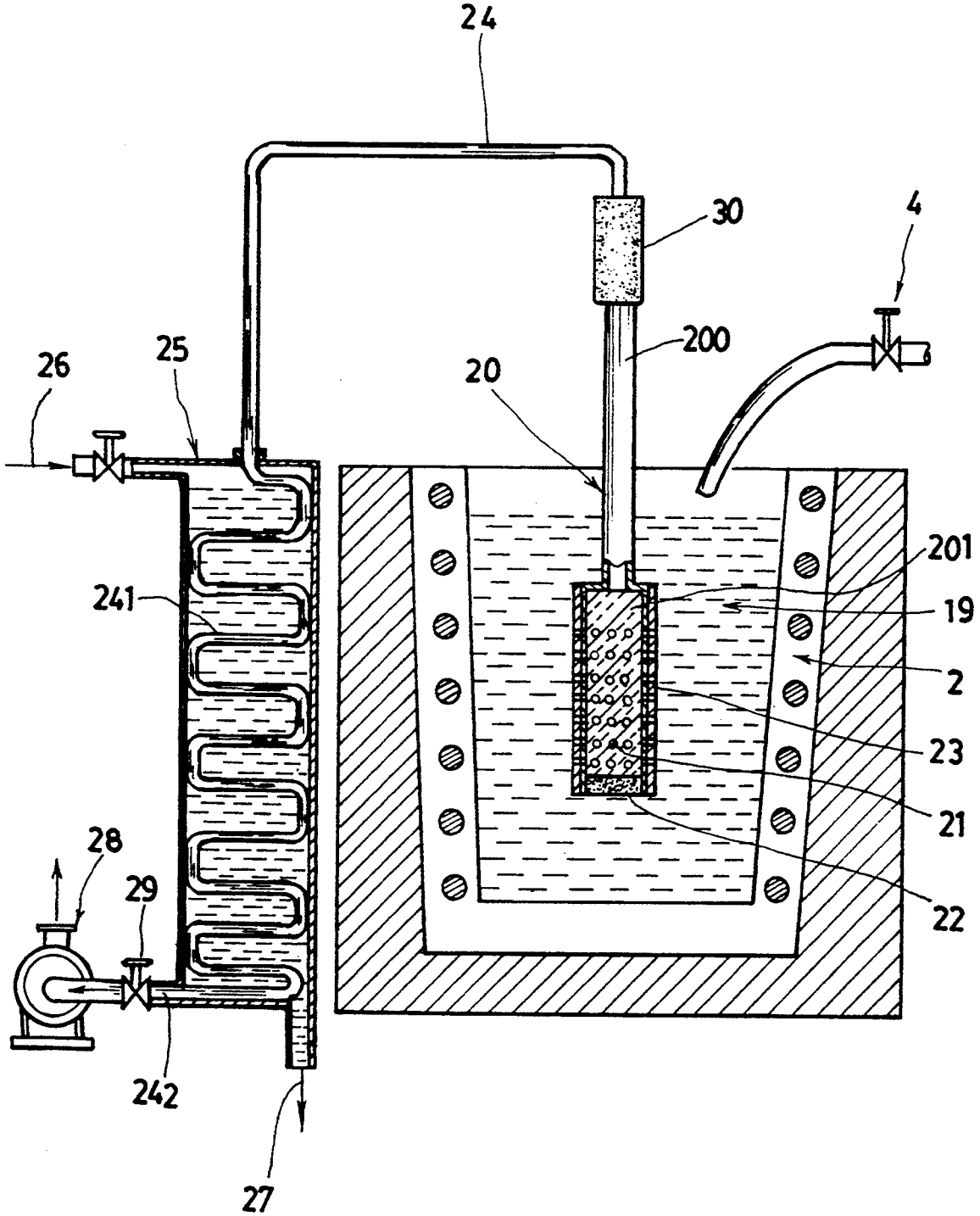
FIG. 2 shows a degassing apparatus in accordance with the present invention.

The degassing means 20 as shown in FIG. 2 includes: a degassing pipe 200 such as made of stainless steel having an enlarged pipe section 201 formed on a suction end of the degassing pipe 200 with a heat-resistant ceramic wool 21 filled in the enlarged pipe section 201 drilled with a plurality of degassing perforations in the enlarged pipe section 201, a refractory clay 22 sealing a bottom opening of the enlarged pipe section 201 and a protective coating 23 such as made of alumina coated on the degassing pipe 200, 201, with the enlarged pipe section 201 submerged in the molten solution 19 in the furnace 2 for removing gases therein. The inert gas is still provided from the inert gas supply means 4 for blanketing use.

The degassing pipe 200 of the degassing means 20 is connected with a flexible hose (such as flexible metal hose) 24 which is connected with a coil exhaust pipe 241 passing through a heat exchanger 25 having cold-water inlet 26 for enterring cold water into the heat exchanger 25 for cooling the exhaust pipe 241 in the exchanger 25 and a warm-water outlet 27 for discharging warm water from the exchanger 25, with an exhaust fan or vacuum pump 28 provided in a tail pipe section 242 connected to the coil exhaust pipe 241 for exhausting the gases as sucked from the suction end of the enlarged pipe section 201 through an exhaust control valve 29 formed on the tail pipe section 242. The control valve 29 will control a system pressure required in the degassing operation.

A ceramic handle 30 may be provided to surround the degassing pipe 200 for safe and easy manipulation of the degassing pipe 200.

Even though the degassing means 2 may be manually operated to insert the suction end portion to every corner in the furnace 2 for a complete gas removal. However, an automatic device such as a robot may be provided for automatically performing such a degassing job, which is not limited in this invention.

By using the equipments as illustrated in FIGS. 1, 2, the present invention can be worked for making metal-matrix composites as reinforced with ultrafine reinforcing materials.

From the aforementioned and the drawing figures accompanied herewith the present invention provides an apparatus for making an aluminum alloy matrix homogeneously reinforced with ultrafine reinforcing material without porosity, to be susperior to any conventional process for making composite since the very fine reinforcing material (even as large as 1 μm) reinforced into the metal matrix by any conventional process may not result in a composite product of homogeneous dispersion without clustering and porosity as effected by this invention.

The present invention may be modified without departing from the spirit and scope as claimed in this invention.

The particle size of the ultrafine reinforcing material of this invention may be made as fine as 0.05 μm, or even finer, which however is not limited in this invention.

I claim:

1. An apparatus a heating furnace having a ceramic cover covering an upper opening of the furnace;

an gas supply means having a conduit connected to the furnace;

a closed feeding container mounted on an upper position of the furnace, having a suspension-liquid valve provided on an upper portion of the feeding container, a heating medium surrounding the feeding container for producing heat convection in the container for heating the suspension liquid in the feeding container, an inert-gas pipe disposed in the feeding container having a plurality of perforations drilled in the inert-gas pipe for bubbling inert gas supplified from an inert gas source through a gas valve formed on an inlet portion of the inert-gas pipe, at least a distributing pipe having a distribution-control valve formed on the distributing pipe and a nozzle secured on a lowest end portion of the distributing pipe for distributing the suspension liquid from the feeding container into the furnace;

an agitating means provided in the furnace for thoroughly mixing the alloy matrix with the suspension liquid distributed from the feeding container; and a degassing means provided in the furnace for removing gases existing in the molten solution by mixing the alloy matrix with the suspension liquid containing the ultrafine reinforcing material for preventing porosity therein.

2. An apparatus according to claim 1, wherein said agitating means includes: an agitator shaft secured to a driving motor mounted above the feeding container having the agitator shaft passing through a central portion in the feeding container and protruding downwardly into the furnace, and a plurality of impellers radially secured to the agitator shaft submerged in the molten solution in the furnace for thoroughly mixing the alloy matrix with the suspension liquid containing the ultrafine reinforcing material.

3. An apparatus according to claim 2, wherein said impellers of said agitating means includes: an upper impeller having a plurality of upper blades generally vertically oriented, with each said upper blade generally perpendicularly to an inside vertical wall of said furnace, with a plurality of blade perforations formed in each said upper blade, said upper blades operatively producing a vortex on an upper surface of a molten solution containing an alloy matrix with an ultrafine reinforcing material in the furnace for thoroughly mixing said alloy matrix with said ultrafine reinforcing material.

4. An apparatus according to claim 2, wherein said impellers of said agitating means includes: a lower impeller having a plurality of lower blades radially secured to a lower portion of the agitator shaft below an upper impeller, the lower blades of the lower impeller operatively producing convection flow in the furnace to thoroughly mix an alloy matrix with an ultrafine reinforcing material in the furnace.

5. An apparatus according to claim 1, wherein said degassing means includes: a degassing pipe having an enlarged pipe section formed on a suction end of the degassing pipe with a heat-resistant ceramic wool filled in the enlarged pipe section drilled with a plurality of degassing perorations in the enlarged pipe section, a refractory clay sealing a bottom opening of the enlarged pipe section and a protective coating coated on the degassing pipe, with the enlarged pipe section submerged in a molten solution containing said alloy matrix and said ultrafine reinforcing material in the furnace for removing gases therein.

6. An apparatus according to claim 5, wherein said degassing pipe of the degassing means is connected with a flexible hose which is connected with a coil exhaust pipe passing through a heat exchanger having a cold-water inlet for enterring cold water into the heat exchanger for cooling the exhaust pipe in the exchanger and a warm-water outlet for discharging warm water from the exchanger, with a vacuum pump provided in a tail pipe section connected to the coil exhaust pipe for exhausting the gases as sucked from the suction end of the enlarged pipe section through an exhaust control valve formed on the tail pipe section.

7. An apparatus according to claim 1, wherein said inert-gas pipe has a by-pass pipe branched from said inert-gas pipe and led into said nozzle of said distributing pipe for atomizing a suspension liquid from said feeding container into said furnace for adding the ultrafine reinforcing material into said metal alloy matrix in said furnace.

* * * * *